US006609355B2

(12) United States Patent
Morden et al.

(10) Patent No.: US 6,609,355 B2
(45) Date of Patent: Aug. 26, 2003

(54) ADJUSTABLE CARTON STOP

(75) Inventors: George A. Morden, Coralville, IA (US); Cletus E. Kreher, Marion, IA (US); Terrance Scherman, Cedar Rapids, IA (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/977,614

(22) Filed: Oct. 15, 2001

(65) Prior Publication Data

US 2003/0070398 A1 Apr. 17, 2003

(51) Int. Cl.[7] ..... B65B 43/08

(52) U.S. Cl. ..... 53/456; 53/563; 53/565; 493/163; 493/165; 493/471

(58) Field of Search ..... 53/456, 457, 458, 53/563, 565; 493/471, 475, 478, 479, 163, 164, 165

(56) References Cited

U.S. PATENT DOCUMENTS

| | | | | |
|---|---|---|---|---|
| 4,986,058 A | * | 1/1991 | Carlsson et al. | 53/563 |
| 4,988,331 A | * | 1/1991 | Boisseau | 493/171 |
| 5,057,068 A | * | 10/1991 | Capdebosc | 493/355 |
| 5,085,029 A | | 2/1992 | Esper | |
| 5,127,212 A | * | 7/1992 | Johnsen et al. | 53/540 |
| 5,480,370 A | * | 1/1996 | Gelsinger | 493/475 |
| 5,910,090 A | * | 6/1999 | Taute | 53/504 |
| 6,073,503 A | | 6/2000 | Matsuno et al. | |
| 6,094,892 A | | 8/2000 | Lees | |
| 6,457,300 B1 | * | 10/2002 | Yang | 53/550 |

FOREIGN PATENT DOCUMENTS

| | | |
|---|---|---|
| EP | 0 863 332 A2 | 9/1998 |
| EP | 0 731 026 B1 | 1/2000 |
| EP | 0 999 135 A1 | 10/2000 |

* cited by examiner

*Primary Examiner*—Eugene Kim
(74) *Attorney, Agent, or Firm*—Pitts & Brittian, P.C.

(57) ABSTRACT

In a packaging machine that includes an elongated mandrel for the formation of a blank into a carton, wherein the mandrel includes a secured end and a distal end, a method and apparatus are provided for correctly positioning the blank relative to the distal end of the mandrel. The carton stop comprises a selectively rotatable tool that includes an engagement segment and is operable from a remote location, an elongated threaded rod that includes a secured end rotatably secured to the packaging machine and a distal end, and an abutment member threadably mounted upon the rod for longitudinal movement along the threaded rod in response to rotation of said threaded rod. The threaded rod defines an engagement segment adapted to engage the engagement segment of the rotating tool.

6 Claims, 3 Drawing Sheets

ADJUSTABLE CARTON STOP

BACKGROUND OF THE INVENTION

1. Field of Invention

The present invention relates generally to the field of packaging equipment and more particularly to apparatus for adjustably positioning a carton blank in a correct position for folding and sealing prior to filling.

2. Description of the Related Art

Packaging machines of the form-fill-seal type generally involve the formation of a carton, filling the carton with a product, and thereafter sealing the carton. Typically, the carton is formed by mounting a carton blank, comprising a paperboard rectangular tube, for example, upon a mandrel, where the bottom of the blank is folded and sealed against a pressure pad. The open-top carton is then removed from the mandrel for filling and then sealing. When the product is a food product, such as juice or milk, the interior of the carton is often maintained aseptic. At the end of a production shift, or at the end of a given production run, or in other instances, it becomes necessary that the portion of the machine that is exposed directly to the product, particularly within a filling station of the machine, be cleaned and/or sterilized. The cleaning operation generally involves flushing clean water over and/or through the components within the packaging machine, followed by drying, in some instances, and sterilization of the cleaned equipment by exposure to a sterilant such as hydrogen peroxide.

Desirably, this cleaning and/or sterilization is accomplished without the disassembly or removal of one or more of the components of the equipment. Following cleaning of the components, the cleaned and/or sterilized equipment is preferably sealed until the machine is again placed into production. Toward these ends, it is common to encase the equipment of a packaging machine within a clean-in-place enclosure, which in most instances comprises a housing capable of being made fluid-tight, and within which the cleaned/sterilized equipment is housed. During operation, portions of this housing are open for the movement of carton blanks into and sealed cartons out of the enclosure, hence through the formation and filling stations. These openings through which the carton blanks and cartons pass are provided with removable covers which, when in place, render the entire housing fluid-tight.

When a carton blank is mounted upon a mandrel for formation, the exact position is important to ensure that the fold lines are properly positioned relative to the pressure pad for closing and sealing the bottom of the carton. Accordingly, a stop mechanism is provided on each mandrel to stop the blank, as it slides over the mandrel, in the correct position, relative to the pressure pad, for closing and sealing.

Packaging equipment is often used to form, fill and seal several different sizes of cartons. For example, a single packaging system may be used to produce both pint and quart size packages. These cartons may have the same cross-section and differ only in height, so that there is no need to replace mandrels or pressure pads for differently sized cartons. However, each differently sized carton requires that the stop mechanism be located at a different position on the mandrel. Accordingly, adjustable stop mechanisms have been provided. In one prior apparatus, the carton stop is adjusted by slidingly mounting the stop mechanism on a post adjacent to the mandrel. The post includes a plurality of spaced-apart grooves. The stop mechanism includes a detent, which may be threaded or spring-loaded, for example, to provide secure engagement with a groove located at the correct position to place the stop mechanism properly for a particular size of carton blank.

Although useful for allowing adjustment for different sizes of cartons, the prior stop mechanism requires manual adjustment. As discussed hereinabove, in many packaging environments, particularly where food is being packaged, the equipment is enclosed during a production run. Accordingly, manual adjustment of the stop mechanism invades the environment and requires a substantial period of time to clean the equipment and re-establish the operating environment. Moreover, the manually operated stop mechanism is adjustable only to very specific, pre-defined positions. It is not adaptable to small adjustments as may be required by slight variations in carton blank size.

SUMMARY OF THE INVENTION

In accordance with one aspect of the present invention, there is provided a novel stop mechanism which is continuously adjustable along the length of a mandrel to accommodate varying sizes of cartons and which is selectively adjustable within an enclosure.

BRIEF DESCRIPTION OF THE DRAWINGS

The above-mentioned features of the invention will become more clearly understood from the following detailed description of the invention read together with the drawings in which.

DETAILED DESCRIPTION OF THE INVENTION

Figure 1:
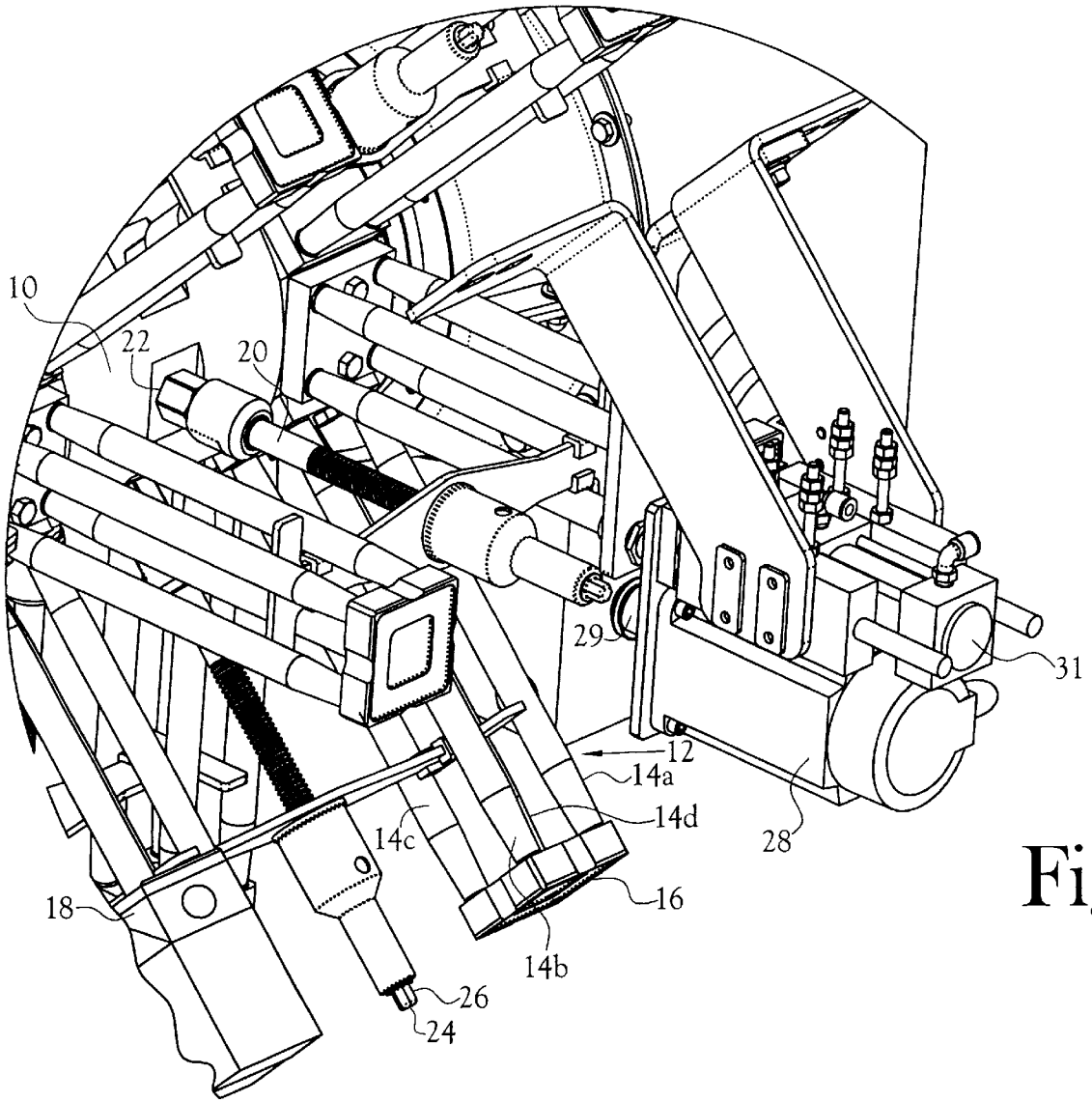
FIG. 1 is a representation of a portion of a packaging machine and depicting a carton forming station thereof, along with certain of the components of the present invention.
Figure 3:
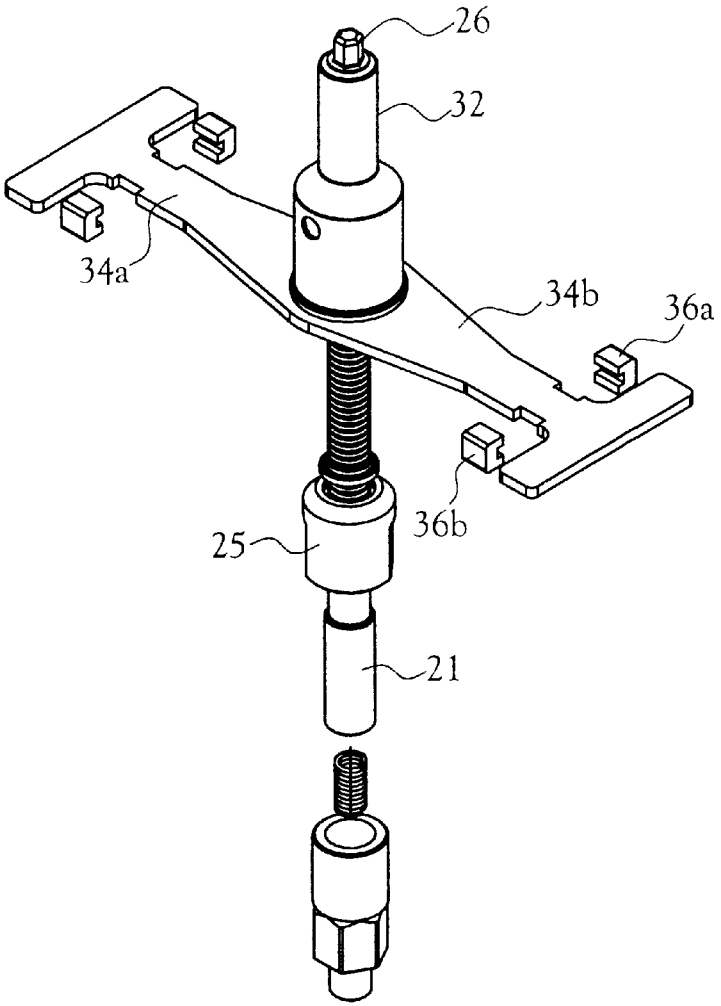
FIG. 3 is an exploded elevation view of the carton stop depicted in FIG. 2.
Figure 2:
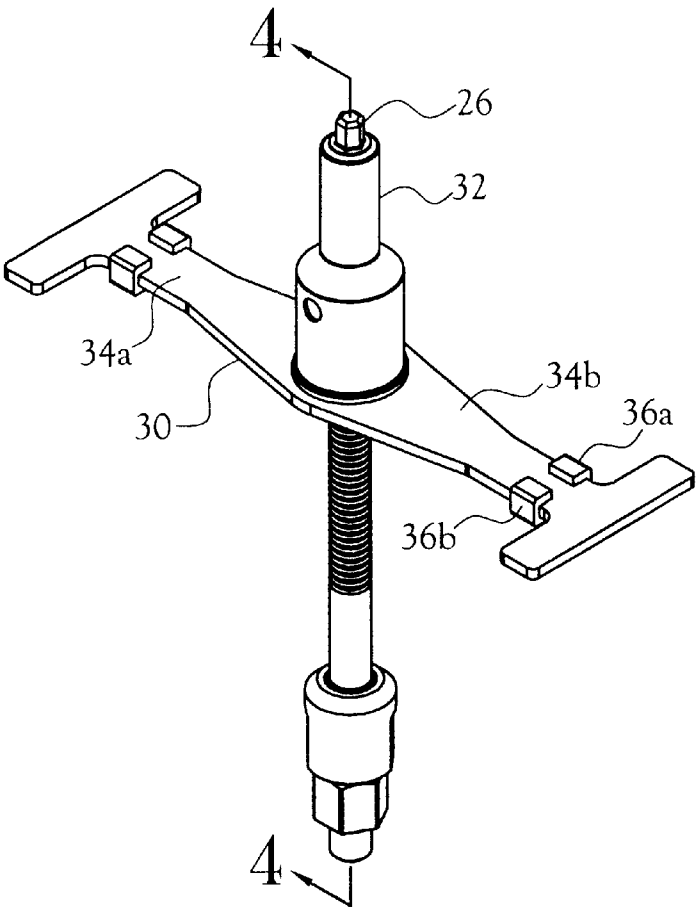
FIG. 2 is a perspective view of a carton stop in accordance with the present invention.
Figure 4:
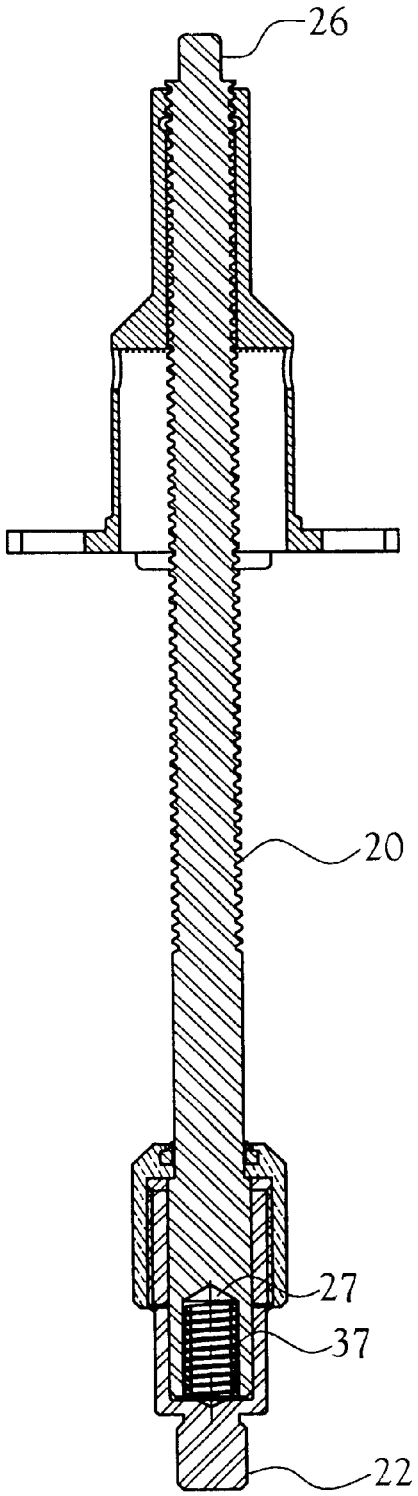
FIG. 4 is a cross-sectional view taken along line A—A in FIG. 2.

Referring now to the Figures in which like reference numerals indicate like or corresponding features, there is shown in FIG. 1 an apparatus for the formation of cartons from blanks. A central rotating hub 10 carries a plurality of mandrels 12. Each mandrel 12 comprises four parallel legs 14*a*, 14*b*, 14*c* and 14*d* and a pressure pad 16, and defines a rectangular prism. Each mandrel 12 is sized to matingly receive a carton blank 18 and retain the carton blank 18 in an expanded condition as the bottom of the carton blank 18 is formed and sealed against the pressure pad 16. In the depicted embodiment, the hub 10 carries sixteen mandrels 12 in two sets of eight radial mandrels equally spaced around the hub 10 at angles of about 45 degrees. A mandrel 12 in each set of eight mandrels 12 is oriented parallel to a mandrel 12 in the other set.

A threaded rod 20, including a secured end 22 and a distal end 24, is rotatably mounted upon the hub 10 between each pair of parallel mandrels 12 and is oriented parallel to the pair of mandrels 12 on either side. The threaded rod 20 is substantially the same length as the mandrels 12. An enlarged section of the threaded rod 20, adjacent to the secured end 22, defines a shoulder 21 that is enclosed within a cap 25 secured to the hub 10. A bore 27 is defined in the secured end 22 of the threaded rod 20. A coil spring 37 is located within the bore 27 to urge the threaded rod 20 away from the hub 10 and absorb the impact when the rotatable tool 28 engages the threaded rod.

The distal end 24 of the threaded rod 20 is formed to provide an engagement segment 26. In the depicted embodiment, the engagement segment 26 is hexagonal in cross-section, adapted for mating engagement with an engagement segment 29 of a rotatable tool 28.

An abutment member 30 is threadably mounted upon the treaded rod 20 for longitudinal movement along the threaded rod 20. The abutment member 30 comprises an elongated, interiorly threaded sleeve 32 and two stop panels 34*a* and 34*b*. The stop panels 34*a* and 34*b* extend radially from the sleeve 32 in opposing directions. Each of the stop panels 34*a* and 34*b* extends within a slot defined by two legs 14*a* and 14*d* of one mandrel of each pair of mandrels 12. Each of the stop panels 34*a* and 34*b* includes two opposing pads 36*a* and 36*b* that contact the legs 14*a*, 14*b*, 14*c* and 14*d*, respectively, to prevent rotation of the abutment member 30 as the threaded rod 20 is rotated.

The rotatable tool 28 is provided for selectively rotating the engagement segment of the threaded rod 20. In the depicted embodiment, the rotatable tool 28 comprises an electrically or pneumatically operable wrench known to those skilled in the art. The rotatable tool is mounted within the packaging machine and operable from a remote location using hydraulic, pneumatic or electrical or mechanical means known to those skilled in the art. An engagement segment 29 of the rotatable tool 28 is selectively moveable by a piston cylinder 31 between a storage position and an engagement position. In the storage position, the engagement segment 29 is withdrawn from of the path of the threaded rods 20 as the hub 10 rotates. In the engagement position, the tool 28 is extended to matingly engage the engagement segment of a threaded rod 20.

In operation, prior to activation of the packaging equipment, the tool 28 is moved from the storage position to the engagement position for matingly engaging the engagement segment 26 of a threaded rod 20. The engagement segment of the tool 28 is electrically or pneumatically rotated, causing the rod 20 to rotate. Rotation of the rod 20 induces longitudinal movement of the abutment member 30 relative to the threaded rod 20. The stop panels 34*a* and 34*b* are moved to the appropriate positions for the size of the carton blank to be formed. The precise position of the stop panels 34*a* and 34*b* may be identified visually by the operator or by sensing equipment, for example, known to those skilled in the art. The rotating tool 28 is withdrawn from engagement with the engagement segment 26 of the threaded rod 20 and the hub 10 is rotated approximately 45 degrees to put another threaded rod 20 in a position for engagement with the rotating tool 28. In this manner, all of the stop panels 34*a* and 34*b* are positioned identical distances from the respective platforms 16. Thereafter, the rotating tool is returned to its storage position.

When an operator desires to fill a different size package, such as switching from a quart-size to a pint size package, there is no need to open the compartment containing the hub 10. In a manner similar to the initial setting of the positions of the stop panels, when the hub 10 is stopped, the tool 28 is moved from the storage position to the engagement position to matingly engage the engagement segment 26 of the threaded rod 20. Rotation of the tool 28 induces longitudinal movement of the abutment member 30. Rotation of the tool 28 in one direction causes the abutment member 30 to move toward the pressure pad 16. Rotation of the tool 28 in the opposite direction causes the abutment member to move away from the pressure pad 16. Again, the precise location of the stop panels may be identified visually by the operator or by sensing equipment, for example. In this manner, the eight threaded rods 20 are sequentially rotated to properly position all of the stop panels 34*a* and 34*b* for the new size carton blank 18. The tool 28 is once again returned to the storage position and the hub begins rotation to form the new size cartons on the mandrels 12.

Whereas the present invention has been described in specific terms for purposes of clarity and understanding, it will be recognized by one skilled in the art that various modifications and/or alternatives may be employed without departing from the substance of the invention. It is intended, therefore, that the present invention be limited only as set forth in the claims appended hereto.

What is claimed:

1. In a packaging machine including an elongated mandrel for the formation of a blank into a carton, said mandrel including a secured end and a distal end, a blank stop for longitudinal positioning of said blank relative to said distal end of said mandrel, said blank stop comprising:

a selectively rotatable tool including an engagement segment and operable from a remote location;

an elongated threaded rod including a secured end rotatably secured to said packaging machine and a distal end, said threaded rod defining an engagement segment adapted to engage said engagement segment of said rotating tool;

said engagement segment of said selectively rotatable tool being selectively movable from a remote location between a position of engagement with said engagement segment of said threaded rod and a storage position of non-engagement with said engagement segment of said threaded rod; and an abutment member threadably mounted upon said rod for longitudinal movement along said threaded rod in response to rotation of said threaded rod.

2. The improvement of claim 1 wherein said mandrel defines a longitudinal slot and a portion of said abutment member moves longitudinally within said slot.

3. The improvement of claim 1 wherein said mandrel and said threaded rod are mounted upon a rotatable hub.

4. A method for adjusting the position of a blank stop in a packaging machine including an elongated mandrel for the formation of a blank into a carton comprising the steps of:

mounting a selectively rotatable tool including an engagement segment on said packaging machine;

rotatably securing a secured end of an elongated threaded rod in said packaging machine, said threaded rod defining an engagement segment adapted to engage said engagement segment of said rotatable tool;

threadably mounting an abutment member upon said rod for longitudinal movement along said threaded rod in response to rotation of said threaded rod;

selectively moving from a remote location said engagement segment of said selectively rotatable tool between a position of engagement with said engagement segment of said threaded rod and a storage position of non-engagement with said engagement segment of said threaded rod; and operating said rotatable tool from a remote location to rotate said threaded rod.

5. The method of claim 4 and further comprising the step of moving a portion of said abutment member within a longitudinal slot defined in said mandrel.

6. The method of claim 4 and further comprising the step of mounting said mandrel and said threaded rod on a rotatable hub.

* * * * *